US007281523B2

(12) United States Patent
Menon et al.

(10) Patent No.: US 7,281,523 B2
(45) Date of Patent: Oct. 16, 2007

(54) FUEL INJECTOR PUMP SYSTEM WITH HIGH PRESSURE POST INJECTION

(75) Inventors: Sree Menon, Grand Rapids, MI (US); Brent Brower, Byron Center, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/545,218

(22) PCT Filed: Feb. 12, 2003

(86) PCT No.: PCT/US03/04328

§ 371 (c)(1),
(2), (4) Date: May 25, 2006

(87) PCT Pub. No.: WO2004/072470

PCT Pub. Date: Aug. 26, 2004

(65) Prior Publication Data

US 2006/0233651 A1 Oct. 19, 2006

(51) Int. Cl.
*F02M 37/06* (2006.01)
*F02M 37/04* (2006.01)

(52) U.S. Cl. ..... 123/508; 123/514; 123/299

(58) Field of Classification Search ..... 123/446, 123/506, 508, 514, 299, 300
See application file for complete search history.

(56) References Cited

U.S. PATENT DOCUMENTS 4,545,352 A * 10/1985 Jourde et al. ..... 123/447
5,740,775 A * 4/1998 Suzuki et al. ..... 123/299
5,893,350 A * 4/1999 Timms ..... 123/467
6,189,509 B1 * 2/2001 Froment ..... 123/467
6,491,017 B1 12/2002 Mahr et al.
6,688,277 B1 * 2/2004 Mahr et al. ..... 123/299
6,763,809 B2 * 7/2004 Grabandt ..... 123/467
6,796,290 B2 * 9/2004 Boehland et al. ..... 123/446
6,843,053 B2 * 1/2005 Draper et al. ..... 60/274
6,904,893 B2 * 6/2005 Hotta et al. ..... 123/447
7,165,527 B2 * 1/2007 Okude et al. ..... 123/299
2002/0134359 A1 9/2002 Rodriguez-Amaya et al.
2002/0170537 A1 11/2002 Reusing
2003/0010846 A1 1/2003 Rodriguez-Amaya et al.
2003/0101968 A1 * 6/2003 Egler ..... 123/446
2003/0131825 A1 * 7/2003 Boehland et al. ..... 123/446
2004/0079335 A1 * 4/2004 Rodriguez-Amaya et al. ... 123/446

FOREIGN PATENT DOCUMENTS

DE 199 39 421 A1 3/2001
EP 1 243 785 A2 3/2002
EP 1 260 700 A1 4/2002
EP 1 260 705 A1 4/2002

* cited by examiner

*Primary Examiner*—Mahmoud Gimie
(74) *Attorney, Agent, or Firm*—McGarry Bair PC

(57) ABSTRACT

High pressure post injection using only one valve is accomplished by fluidly connecting the control valve (76) in a fuel injection pump system (50) to the upper nozzle chamber (70) of a fuel injector (60), and connecting the upper nozzle to a reservoir (80) by way of a restriction. The restriction creates enough residual pressure in the fuel circuit to enable high pressure post injection by closing the control valve (76) a second time.

8 Claims, 3 Drawing Sheets

FUEL INJECTOR PUMP SYSTEM WITH HIGH PRESSURE POST INJECTION

CROSS-REFERENCE TO RELATED APPLICATIONS

This application claims priority on International Application No. PCT/US03/04328, filed Feb. 12, 2003.

BACKGROUND OF THE INVENTION

1. Field of the Invention

This invention relates to pump systems for fuel injection systems.

2. Description of the Related Art

Engine exhaust emission regulations are becoming increasingly restrictive. One way to meet emission standards is to precisely control the quantity and timing of the fuel injected into the combustion chamber to match the engine cycle. For certain engine operating conditions, effective injection rate shaping may result in reduced levels of particulates and oxides of nitrogen in the engine exhaust. For example, a pilot injection prior to the main injection event is known to reduce $NO_x$ emissions and a high pressure post injection close to the main injection event is known to reduce particulate emissions.

Some existing rate shaping techniques attempt to control injection rates by making various modifications to the injector nozzle assembly. A newer rate shaping technique utilizes a spill or control valve to control pressure build up within the injector and a separate needle control valve to meter and time the different injection events.

Two control valves are costly to make and to maintain. There is a need for a simpler structure that will provide effective high-pressure post injection close to the main injection event.

SUMMARY OF THE INVENTION

A pump system according to the invention is specifically designed for a fuel injection system in a diesel engine. The pump system has a pumping chamber, a plunger disposed in the pumping chamber for pressurizing fuel, and a fuel injector having an upper nozzle chamber, a lower nozzle chamber and a needle valve. Higher pressure in the lower nozzle chamber opens the needle valve and a needle spring closes the needle valve when the upper and lower nozzle chambers are at the same pressure. A fluid line connects the pumping chamber to the lower nozzle chamber. A control valve is fluidly connected between the pumping chamber or the fluid line and the upper nozzle chamber. The upper nozzle chamber in turn is fluidly connected to a reservoir with a restriction between the upper nozzle chamber and the reservoir. With the invention, a high pressure post injection event can occur without the need for a second control valve.

Preferably, the upper nozzle chamber is connected to the reservoir by a drain line and the restriction is in the drain line. Further, the drain line can have a relief valve in parallel with the restriction. The invention can further include a supply line fluidly connecting the reservoir with the pumping chamber, in which case there can also be a check valve in the supply line.

In another aspect of the invention, a method of providing high pressure post injection is achieved in a fuel injection system where a control valve is fluidly connected between a high-pressure fluid source and an upper nozzle chamber in a fuel injector. The upper nozzle chamber is fluidly connected to a reservoir by way of a restriction. The method is accomplished by closing the control valve after a main injection event. Residual pressure in the fuel circuit caused by the restriction is sufficient to enable high pressure post injection.

DESCRIPTION OF THEE PREFERRED EMBODIMENTS

Figure 1:
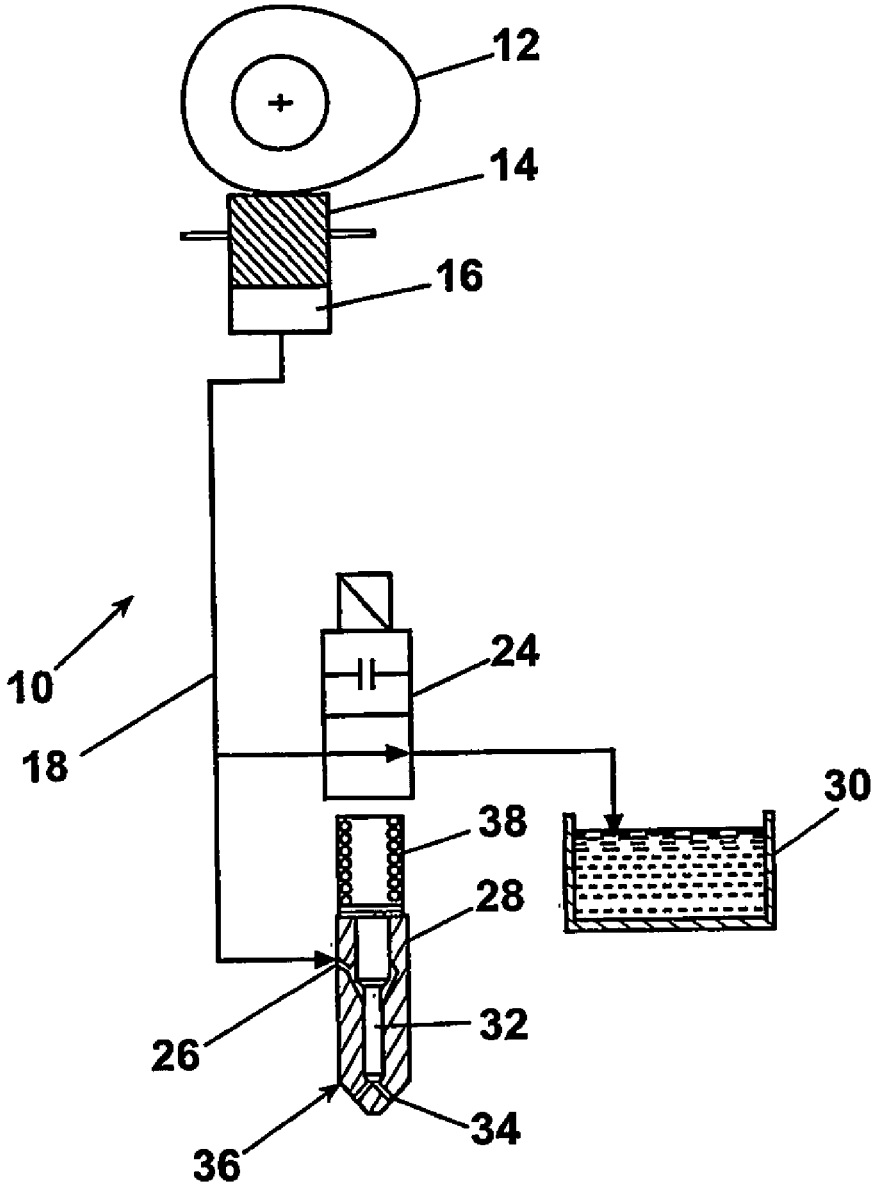
Fig. 1 (PRIOR ART)
FIG. 1 is a schematic diagram of a prior art fuel injector pump system.

A conventional pump system for a known fuel injection system is generally indicated schematically at 10, in FIG. 1. An engine driven cam 12 drives a plunger 14. The pumping chamber 16 within which the plunger 14 reciprocates is connected to an injector 28 via a high-pressure fluid line 18.

A spill or control valve 24 is disposed to route pressurized fuel from the pumping chamber 16 to the pumping system outlet 26, which in turn, connects to the injector 28 when the control valve 24 is closed. When the control valve 24 is open, fuel flow from the pumping chamber 16 bypasses the injector 28, "spilling" to a low-pressure reservoir 30. The injector 28 has a needle 32 that is biased to close spray holes 34 in the nozzle 36 by a spring 38.

Fuel injection is triggered by closing the control valve 24, which normally occurs electronically. With the control valve 24 closed, pumping action of the plunger 14 increases fuel pressure in the fluid line 18 and the injector 28. When pressure in the injector 28 surpasses the force of the spring 38, the needle 32 lifts, opening the spray holes 34 for the main injection event, where the pressurized fuel exits the nozzle 36 through the spray holes 34. When the control valve 24 is opened, pressure in the fluid line 18 and the injector 28 is reduced due to fuel spilling to the drain 30, and the spring 38 forces the needle 32 to close the spray holes 34 ending the main injection.

Figure 2:
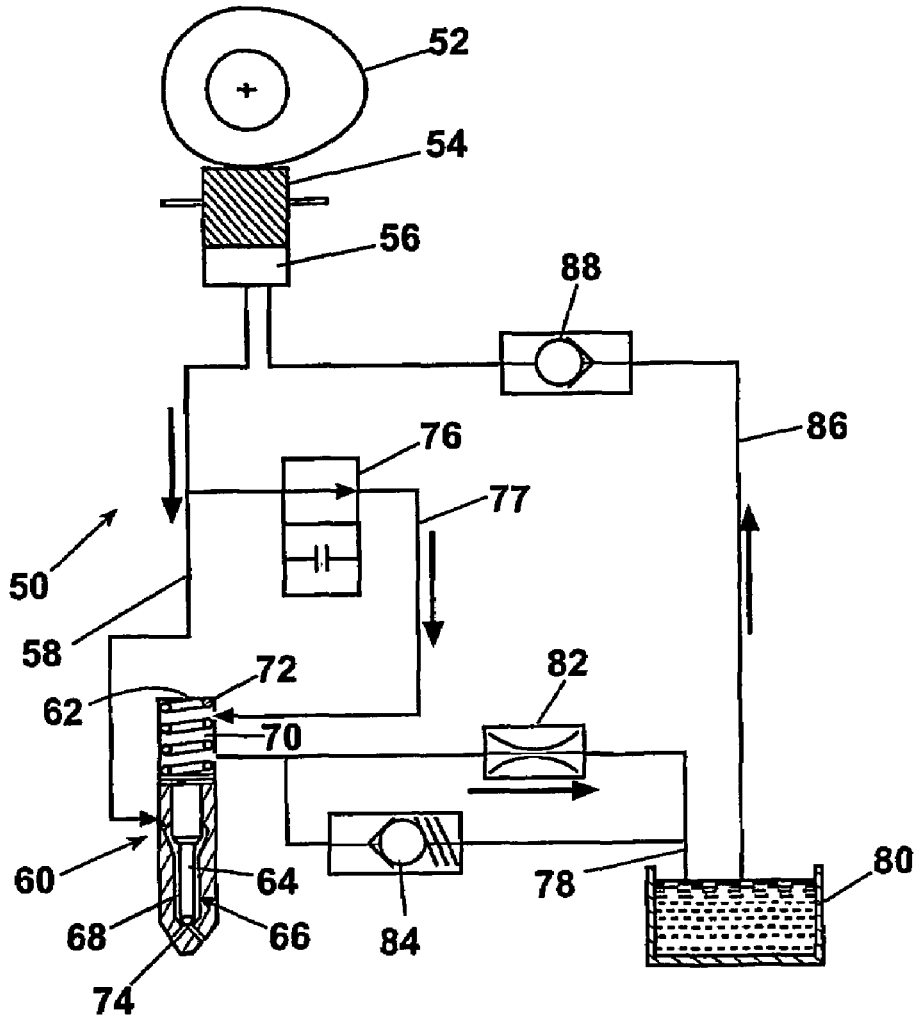
FIG. 2 is a schematic diagram of a fuel injector pump system according to the invention.

Looking now at FIG. 2, a pump system 50 according to the invention is schematically illustrated. An engine driven cam 52 drives a plunger 54 within a pumping chamber 56. The pumping chamber 56 within which the plunger 54 reciprocates is connected to an injector 60 via a high-pressure fluid line 58. The fluid line 58 typically connects to the injector 60 at a pump outlet 62. The injector 60 comprises a needle 64 that reciprocates within a nozzle chamber 66. The nozzle chamber 66 has two portions, a lower nozzle chamber 68 and an upper nozzle chamber 70. The high-pressure fluid line 58 communicates with the lower nozzle chamber 68. The needle 64 is biased by a spring 72 to a position where it closes spray holes 74 in the nozzle.

A spill or control valve 76 connects to the fluid line 58 upstream of the injector 60 and also to the upper nozzle chamber 70 through a control line 77. A separate drain line 78 connects the upper nozzle chamber 70 to a low-pressure reservoir 80. The drain line 78 has a restriction 82 and a relief valve 84 in parallel. The relief valve 84 is normally closed. A low-pressure supply line 86 runs from the reservoir 80 to the pumping chamber 56 through a one-way check valve 88.

Operation is as follows. In a fill cycle, the plunger 54 is moving to a retracted position (up in FIG. 2), and fuel enters the pumping chamber 56 via the supply line 86. As the plunger 54 commences its downstroke toward an extended position, the control valve 76 is initially open, spilling fuel from the high-pressure fluid line 58 to the upper nozzle chamber 70 and draining it to the reservoir 80 via the drain line 78. The main injection event is triggered by closing the control valve 76, which causes pressure to build in the pumping chamber 56, the high-pressure fluid line 58 and the lower nozzle chamber 68. When pressure in the lower nozzle chamber 68 exceeds the force of the spring 72, the needle 64 lifts, opening the spray holes 74, and beginning the main injection. The main injection event is ended by momentarily opening the control valve 76, simultaneously reducing pressure in the lower nozzle chamber 68 and raising pressure in the upper nozzle chamber 70 as high pressure fuel is directed from the control valve to the upper nozzle chamber 70 through the control line 77. The increased pressure above the needle 64, added to the force of the needle spring 72, causes the needle 64 to close the spray holes 74, ending the main injection event.

However, unlike a conventional injector, pressure in the fuel circuit does not decay very rapidly because the only outlet upon opening the control valve 76 is through the restriction 82 in the drain line 78. The control valve 76 can be closed again, after the main injection event, while the plunger 54 is continuing its downstroke. This triggers a post injection event at high pressure because pressure builds up again in the pumping chamber 56, the high-pressure fluid line 58 and the lower nozzle chamber 68. Meanwhile, pressure in the upper nozzle chamber 70 continues to decrease because of the open drain line 78 through the restriction 82 to the reservoir 80. The residual pressure in the fuel circuit plus the continued pumping action of the plunger 54 is sufficient to overcome the force of the spring 72, thereby lifting the needle 64 again and causing another injection at high pressure after the main injection event. Post injection ends when the control valve 76 is opened. The relief valve 84 is available to prevent excessive pressure build up inside the injector 60.

Figure 3:
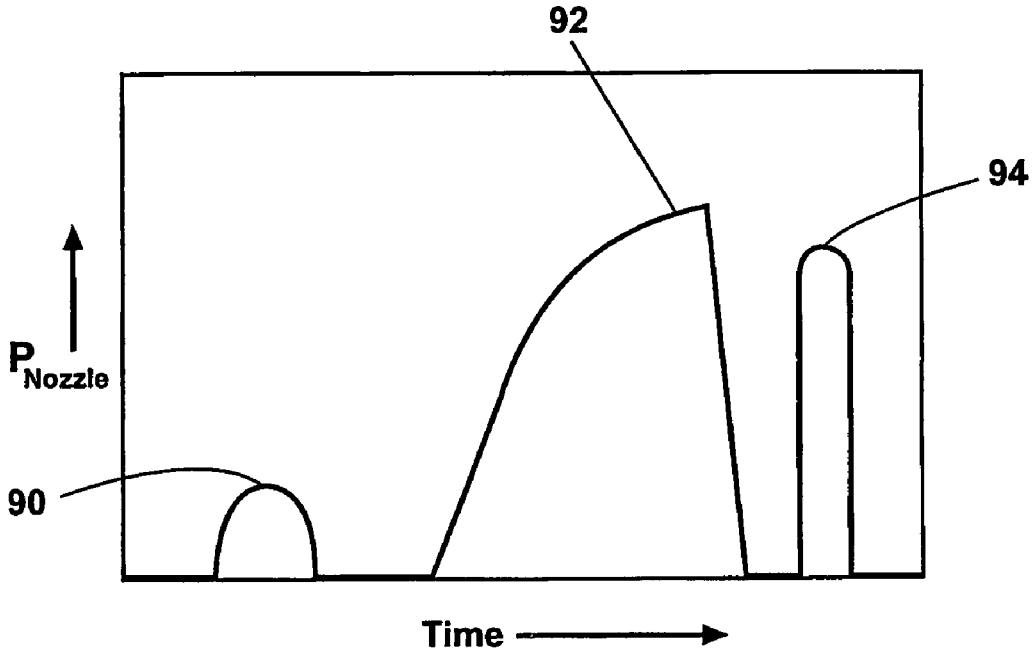
FIG. 3 is a chart plotting fuel pressure at the nozzle over time for a single injection cycle.

FIG. 3 shows a plot of pressure in the lower nozzle chamber 68 over time during the injection cycle. A pilot injection is shown by a first pressure spike 90 and is typically accomplished in a manner well known in the art. A second pressure spike 92 occurs during the main injection event. The post injection event is shown by a third pressure spike 94, achieved by the invention according to the description above. It is important to note that high pressure post injection is achieved by using only a single valve, i.e., the control valve 76.

A pump system according to the invention may be a unit pump connected via a high-pressure fluid line to an injector, or alternatively, may be part of a unit injector. Further, it is appreciated that although one embodiment of the present invention is broadly illustrated in FIG. 2, there are many different ways to implement the present invention in accordance with the schematic illustration in FIG. 2.

While the invention has been specifically described in connection with certain specific embodiments thereof, it is to be understood that this is by way of illustration and not of limitation, and the scope of the appended claims should be construed as broadly as the prior art will permit.

We claim:

1. A pump system for a fuel injection system in a diesel engine, the pump system having:

a pumping chamber;

a plunger disposed in the pumping chamber for pressurizing fuel;

a fuel injector having an upper nozzle chamber, a lower nozzle chamber and a needle valve biased to a closed position by a spring wherein higher pressure in the lower nozzle chamber than in the upper nozzle chamber opens the needle valve and the spring closes the needle valve when pressure in the lower nozzle chamber is not higher than in the upper nozzle chamber;

a fluid line connecting the pumping chamber to the lower nozzle chamber; and no more than one control valve fluidly connected between the pumping chamber or the fluid line and the upper nozzle chamber, wherein the upper nozzle chamber is fluidly connected to a reservoir with a restriction between the upper nozzle chamber and the reservoir, whereby a high pressure post injection event can occur without the need for a second control valve.

2. A pump system according to claim 1 wherein the upper nozzle chamber is connected to the reservoir by a drain line.

3. A pump system according to claim 2 wherein the drain line has a relief valve in parallel with the restriction.

4. A pump system according to claim 1 and further comprising a supply line fluidly connecting the reservoir with the pumping chamber.

5. A pump system according to claim 4 further comprising a check valve in the supply line.

6. A pump system according to claim 2 and further comprising a supply line fluidly connecting the reservoir with the pumping chamber.

7. A pump system according to claim 3 and further comprising a supply line fluidly connecting the reservoir with the pumping chamber.

8. A method of providing high pressure post injection in a fuel injection system wherein no more than one control valve is fluidly connected between a high pressure fluid source and an upper nozzle chamber in a fuel injector, and the upper nozzle chamber is fluidly connected to a reservoir by way of a restriction characterized by: closing the control valve after a main injection event whereby residual pressure in the fuel circuit caused by the restriction is sufficient to enable high pressure post injection.

* * * * *